United States Patent [19]

Smitte et al.

[11] Patent Number: 4,580,852

[45] Date of Patent: Apr. 8, 1986

[54] REFRIGERATOR CABINET ASSEMBLY

[75] Inventors: Cory T. Smitte, Hamilton; Anton Pichler, Weston; Edward McGinnis, Stoney Creek, all of Canada

[73] Assignee: Inglis Limited, Mississauga, Canada

[21] Appl. No.: 566,528

[22] Filed: Dec. 29, 1983

[51] Int. Cl.[4] ..... F25D 11/00

[52] U.S. Cl. ..... 312/214

[58] Field of Search ..... 312/214; 220/62, DIG. 25, 220/4 R, 72, 4 F, 467, 431, 432, 433

[56] References Cited

U.S. PATENT DOCUMENTS

| | | | |
|---|---|---|---|
| 2,115,343 | 4/1938 | Scurlock | 312/214 |
| 2,622,753 | 12/1952 | Philipp | 220/467 |
| 3,014,611 | 12/1961 | Marshall | 220/431 |
| 3,054,362 | 9/1962 | Seidle | 220/4 F |
| 3,091,946 | 6/1963 | Kesling | 312/214 |
| 3,588,214 | 6/1971 | Stimamiglio | 312/214 |
| 4,082,825 | 4/1978 | Puterbaugh | 312/214 |
| 4,463,864 | 8/1984 | Roach | 220/4 F |

*Primary Examiner*—William E. Lyddane
*Assistant Examiner*—Joseph Falk
*Attorney, Agent, or Firm*—Sim & McBurney

[57] ABSTRACT

In a refrigerator cabinet having a rolled-form, three-sided wrapper to form the cabinet sides and top, a front liner, a rear panel having a compressor compartment shell, a molded plastic base for interconnecting the wrapper sides, front liner and rear panel with compressor compartment shell. The base has a support portion molded therein to support a compressor within the compressor compartment. The cabinet can be readily assembled where considerable economies in manufacture are realized.

19 Claims, 9 Drawing Figures

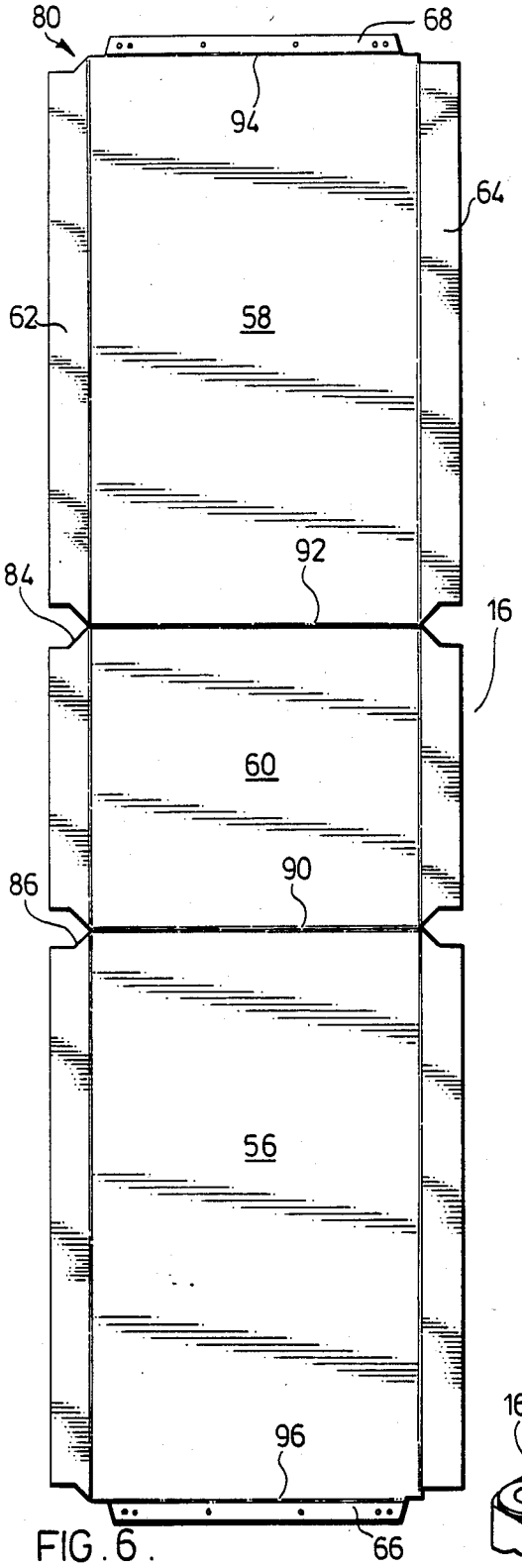
FIG. 6.
FIG. 7.
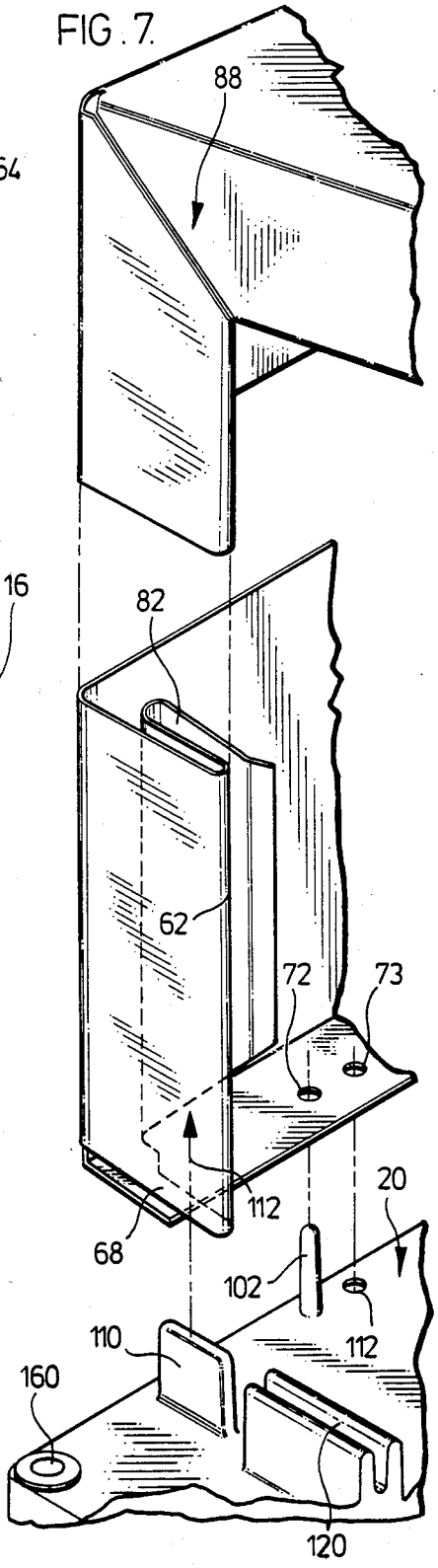

REFRIGERATOR CABINET ASSEMBLY

FIELD OF THE INVENTION

This invention relates to a refrigerator cabinet construction.

BACKGROUND OF THE INVENTION

A common technique in refrigerator cabinet construction is to provide a false bottom in a three-sided refrigerator cabinet shell. An example of this is disclosed in U.S. Pat. No. 3,707,243. The outer wrapper has a three-sided structure which has a false bottom secured in its lower portion. One of the purposes of the false bottom is to define a compressor compartment. Additional support members must be secured to the bottom of the refrigerator to support the compressor assembly for the refrigerator located in the rear compressor compartment. These supports are formed of metal, hence requiring the use of elaborate vibration dampening devices in supporting the compressor on the metal frame.

Another approach to constructing a refrigerator cabinet having a three-sided outer shell is disclosed in Canadian Patent No. 1,001,204. The liner is inserted into the three-sided wrapper which provides the cabinet sides and top. The rear panel includes a bottom portion of sheet metal which is placed into the wrapper to complete the cabinet. The combination rear panel and bottom includes a struck-out portion to accommodate a compressor. Additional metal cross members are required to traverse the opening to compressor compartment. The refrigerator compressor is mounted on the cross members resulting in the same drawbacks as the system of U.S. Pat. No. 3,707,243.

Another technique of cabinet construction is disclosed in U.S. Pat. No. 3,948,410. A wrap-around shell for the cabinet provides the cabinet sides, top and bottom. The rear panel, which is inserted into the cabinet, includes a preformed compressor compartment. A rectangular base member is secured to the underside of the cabinet to support it. Foam insulation is placed beneath the compartment shell and additional structure members are inserted into the compartment shell to support a compressor mounted therein. By having to place foam under the compressor compartment shell for support, the compressor is elevated considerably within the refrigerator cabinet resulting in a reduction in interior space in the cabinet. In roll forming the wrap-around shell arrangement, it is very difficult to control the alignment to ensure that the ends align at the corner where they are joined.

The cabinet construction, according to this invention, eliminates the need for false bottoms in the cabinet, provides significant economies in assembly and permits the mounting of a compressor directly on the base for the cabinet.

SUMMARY OF THE INVENTION

The foam insulated refrigerator cabinet assembly, according to an aspect of the invention, comprises a metal outer wrapper which defines the cabinet sides and top. The outer wrapper is mounted on a molded plastic base. A rear panel having a compressor compartment shell associated with its lower portion is mounted on the rear of the wrapper. A cabinet liner is mounted on the front of the wrapper. The compressor compartment shell has a bottom perimeter which contacts the molded base.

Each cabinet side has a lower marginal edge with means for connection to the base. The cabinet sides and top have front and rear peripheral marginal edges with means for forming a foam tight seal with the liner and rear panel peripheral edges. A foam tight seal is also formed between the base and the bottom perimeter of the compartment shell so as to define a compressor compartment directly above the base. The base has means for forming a foam tight seal with and connection to the liner and any remaining portion of the rear panel to either side of the compressor compartment. A cavity is defined between the assembled components of the wrapper, base, rear panel, compartment shell and liner. The cavity is filled with an expanded foam insulation which becomes rigid to complete the securement of the assembly components.

The method, according to an aspect of this invention for constructing a foam insulated refrigerator cabinet, comprises roll forming a length of metal sheet to form U-shaped channel portions along the front and rear edges of the wrapper and bending the metal sheet to form the wrapper. The rear panel is slid into the wrapper rear U-shaped channels from the bottom open end of the wrapper. The wrapper along its bottom edges has means for co-operating with locator means provided on the base. The base is positioned on the wrapper by engaging the co-operating means of the wrapper with the base locator means and fastening from the underside the base to the wrapper sides. A front liner may be placed into the assembly by either sliding the liner into the wrapper front U-shaped channels from the bottom open end of the wrapper before the base is applied, or the front liner may be snapped into the U-shaped channels of the wrapper front after the base is connected to the wrapper bottom. The assembled wrapper, liner, rear panel, base and compartment shell form a foam tight seal about their junctions. A foam insulation is introduced into the cavity so defined to complete the foam insulated assembly.

According to another embodiment of the invention, in a refrigerator cabinet construction, the rear panel has a cut-out at its bottom which is U-shaped. A molded plastic compressor compartment shell, which has a U-shaped opening, is introduced into the corresponding U-shaped opening of the rear panel. The perimeter of the compressor compartment shell receives the edges of the U-shaped cut-out of the rear panel. The shell has a bottom perimeter which contacts a bottom portion of the cabinet.

BRIEF DESCRIPTION OF THE DRAWINGS

Preferred embodiments of the invention are shown in drawings, wherein:

FIG. 6 is a plan view of the cut out metal sheet prior to roll forming into the three-sided structure;

FIG. 7 is a cut-away view showing in exploded form the aligning of the cabinet side with a base corner portion;

DETAILED DESCRIPTION OF THE PREFERRED EMBODIMENTS

Figure 1:
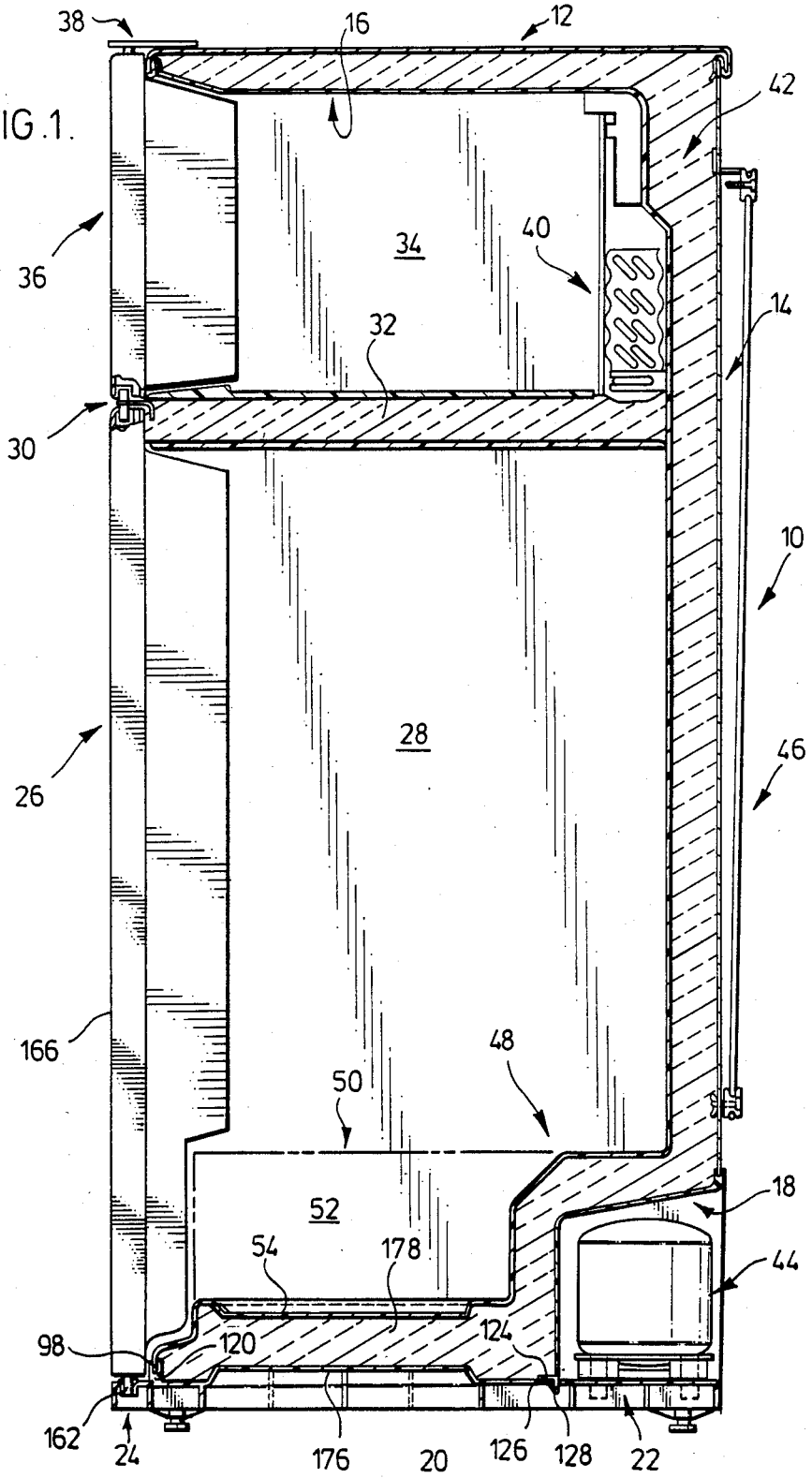
FIG. 1 is a section through a refrigerator having a cabinet construction according to this invention.

The refrigerator cabinet construction, according to a preferred embodiment of this invention, is shown in FIG. 1. The refrigerator cabinet generally designated 10 consists of a metal wrapper 12 with rear panel 14, and front liner 16. The rear panel 14 has associated therewith a compressor compartment shell 18. A base 20 interconnects the wrapper sides of the refrigerator with the front liner, rear panel and compressor compartment shell. No false bottom is required in this cabinet assembly. The base 20 provides a compressor support in the area 22.

The base 20 includes in area 24 a component for the hinge mounting of cabinet door 26 which covers the refrigerator portion 28 of the refrigerator. The upper portion of the cabinet door 26 is hingedly mounted at 30 to the partition 32 which separates the refrigerator compartment from the freezer compartment 34. The upper cabinet door 36 is hinge mounted at 30 and at 38. As schematically shown, the evaporator assembly 40 is provided in the freezer compartment. With the cabinet assembled, a cavity generally designated 42 is defined between the assembled cabinet components of wrapper, rear panel and its compressor compartment shell, the front liner and base. With these components assembled, the cavity 42 is filled with an expandable insulating urethane, foam according to techniques well understood and widely used by those skilled in the field of insulating refrigerator cabinets.

The refrigerator cabinet has a compressor 44 mounted on the compressor support 22 of the base 20 and condensor coils 46 are mounted on the rear of the refrigerator for purposes of the heat exchange in the refrigeration cycle. Because the compressor 44 is mounted directly on the base 20, the compressor compartment shell 18 is sufficiently low enough to provide for a level surface from the jog 48 across upper surface 50 of the crisper compartment 52 as it rests on bottom 54 of the liner. This arrangement thereby increases the usable space within the refrigerator compared to other cabinet arrangements.

Figure 2:
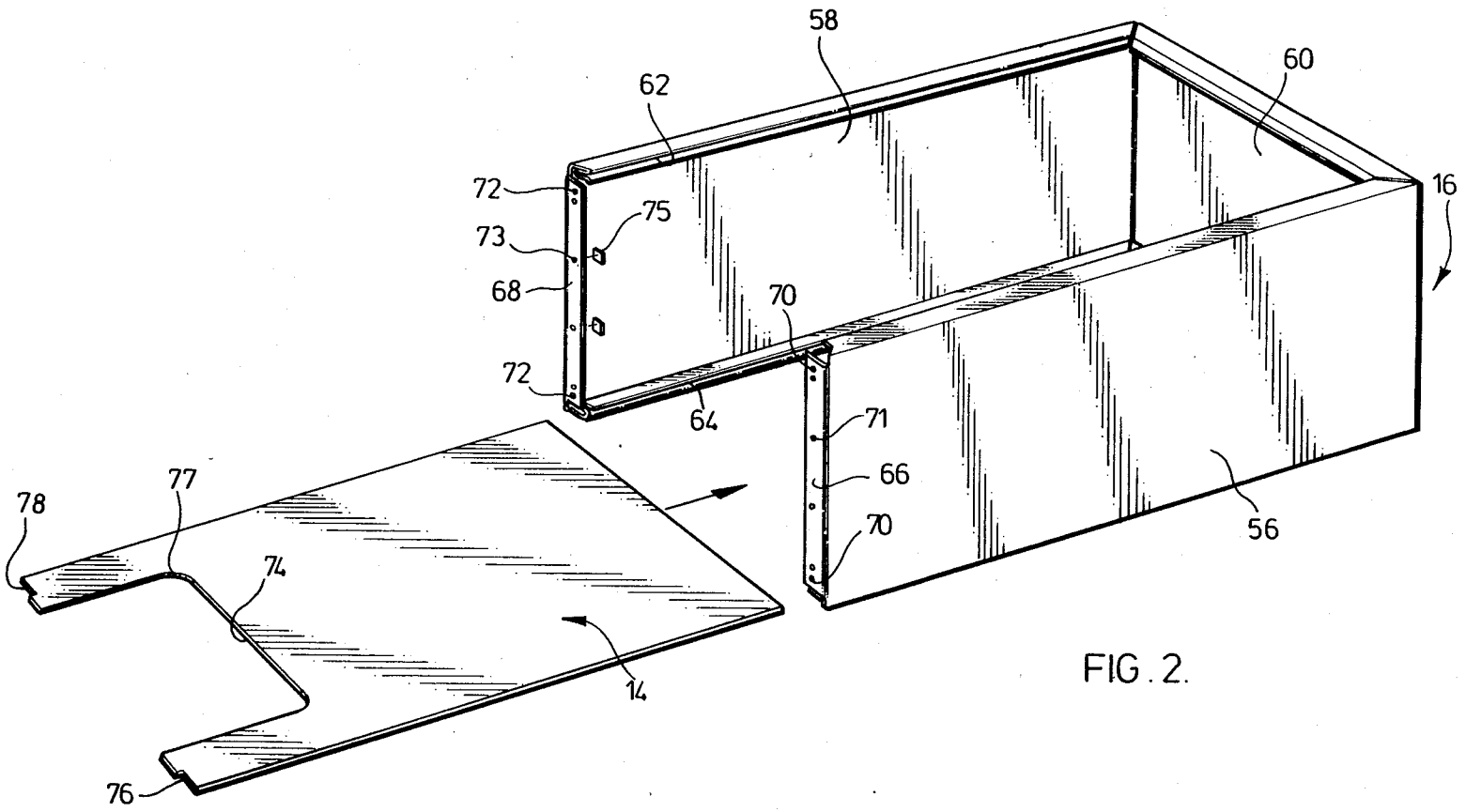
FIG. 2 is a perspective view showing the assembly of the rear panel to the cabinet wrapper.

As shown in FIG. 2, the wrapper 16 for the cabinet assembly 10 has opposing side walls 56 and 58 and a top 60. The front edge 62 and rear edge 64 of the wrapper sides and top each have formed therein a U-shaped channel which is shown in more detail in FIG. 7.

The bottom of the sides 56 and 58 include flange portions 66 and 68 which are provided for purposes of connection to base 20. The flanges 66 and 68 include apertures 70 and 72 which cooperate with corresponding components on the base for purposes of locating the wrapper sides on the base. Apertures 71 and 73 are provided for co-operating with self-tapping screws in affixing the base to the wrapper sides. Top plates 75 are stuck with adhesive behind flanges 66 and 68 over corresponding apertures 71 and 73. The self-tapping screws, as applied from the base underside, are screwed onto top plates 75 to secure the base to the flanges.

Figure 8:
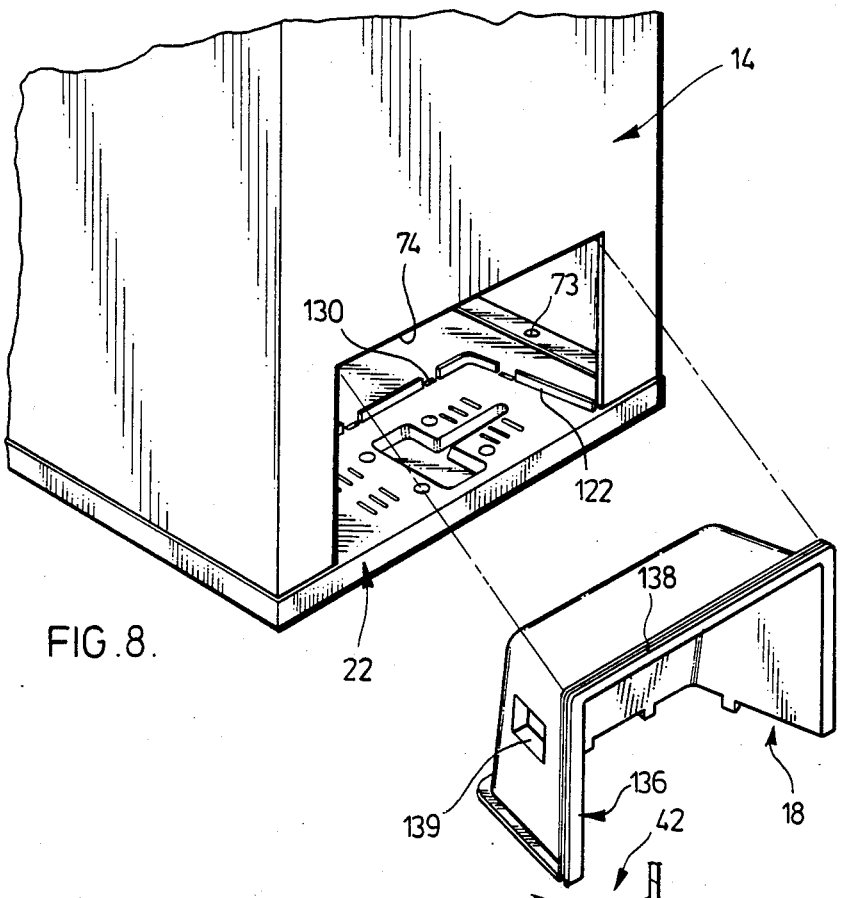
FIG. 8 is a perspective view showing the location of a molded plastic compressor compartment shell.

The rear panel 14 has a U-shaped opening 74 with radiused corners 77 cut therein to receive the corresponding U-shaped perimeter of the front of the compressor compartment shell which is shown in more detail in FIG. 8. The bottom of the rear panel 14 includes notches 76 and 78 which permit insertion of base locator components into the respective edge corner portions of the wrapper sides 56 and 58.

To assemble the refrigerator cabinet, the wrapper 16 is formed from a blank 80 as shown in FIG. 6. The blank 80 is die cut from a length of metal sheet so as to provide the cabinet sides 56, 58 and top 60. The edges 62 and 64 are rolled formed so as to provide the U-shaped recesses 82 as shown in more detail in FIG. 7. Cut outs 84 and 86 are provided so that when the wrapper 16 is folded, the corners form a miter joint 88 of FIG. 7. A plastic cap 89 of FIG. 3 may be inserted between the spaced edges of the miter joint 88 to provide a finished corner. The wrapper 16 is folded about lines 90 and 92 to provide the three-sided structure as shown in FIG. 2. It is also folded about lines 94 and 96 to provide the laterally extending flange portions 66 and 68.

It should be noted that the cut out arrangement for the wrapper is symmetrical about the centre line. Because of this symmetry, it is possible to form the blank from metal sheet which is painted on both sides. This is an advantage in the refrigerator industry where at present two colors form the predominant portion of the market, namely white and almond. Thus, the sheet metal may be painted white on one side and almond on the other side and rerolled. Depending upon the color of the wrapper required, the sheet may be appropriately unrolled from the rolled painted stock in the direction which provides the desired exterior color facing upwardly.

The cabinet may be assembled in a variety of ways. According to the embodiment of FIG. 2, the rear panel is inserted into the wrapper rear peripheral channel portions through the open bottom of the three-sided wrapper.

Figure 3:
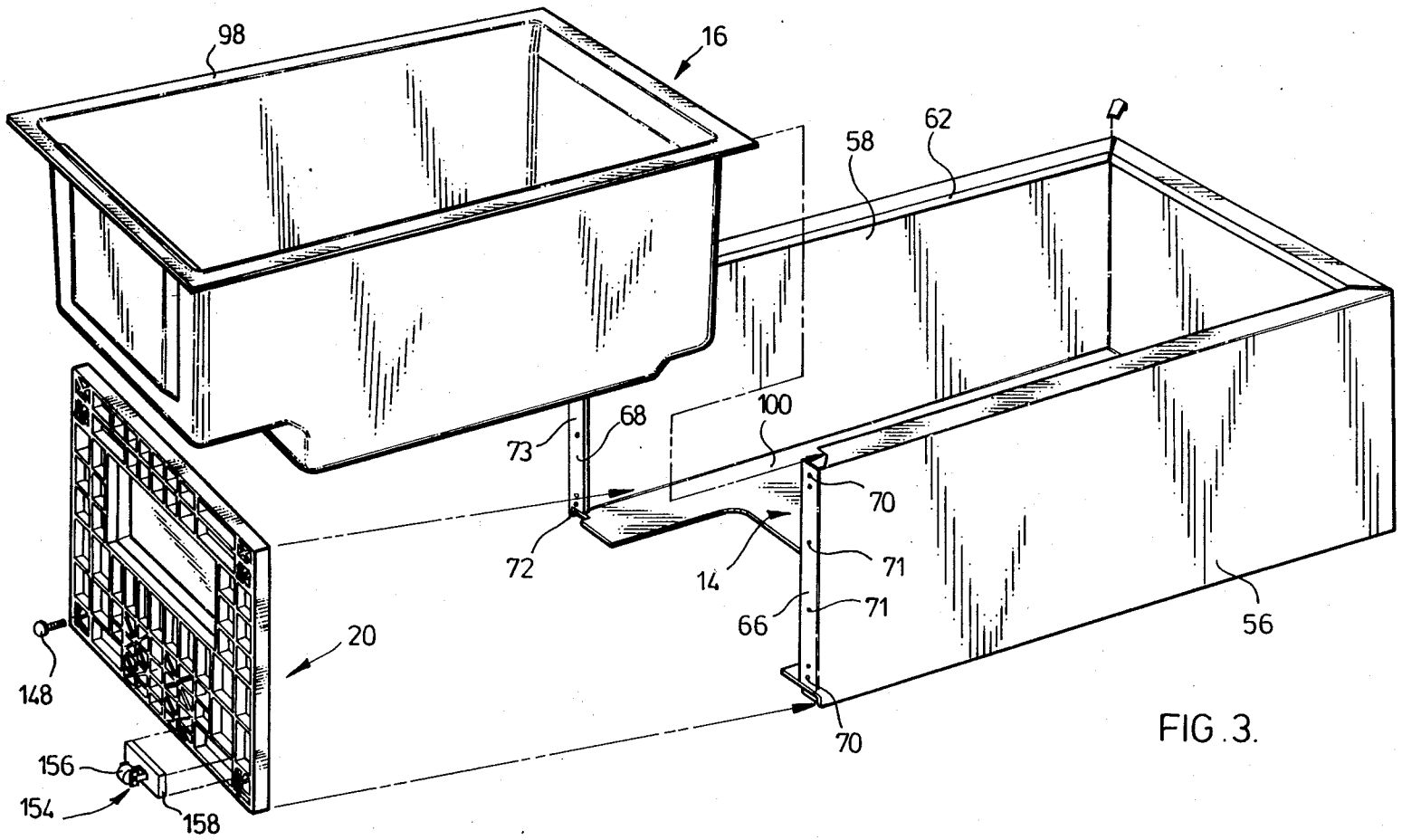
FIG. 3 is a perspective view showing the assembly of the front liner and base assembled to the unit of FIG. 2.

Subsequent to insertion of the rear panel as shown in FIG. 3, the liner 16 with peripheral edge 98 is inserted through the open bottom of the wrapper into the front edge 62 of the wrapper in the direction of arrow 100. With the liner in place, the base 20 is placed onto the flanges 66 and 68 to interconnect the wrapper sides 56 and 58 with the liner 16 and the rear panel 14. Locating devices on the base, which will be discussed with respect to FIG. 7, are used to align the wrapper with the base. Fasteners, as applied from the underside of the base 20, pass through the base and flange apertures 71 and 73 into the tap plates 75 to secure the connection of wrapper to base. In the assembly of FIG. 3, the compressor compartment shell 18 may be placed in the rear panel 14 before the panel is slid into the wrapper, or optionally as shown in FIG. 8, the compressor compartment shell can be snap fitted into the U-shaped opening 74 after the assembly of FIG. 3.

Another approach to assembling the cabinet is to insert the rear panel into the wrapper and affix the base with compartment shell to the wrapper bottom. The liner is then snap fitted into the channels in the front of the wrapper and base to complete the assembly.

Figure 4:
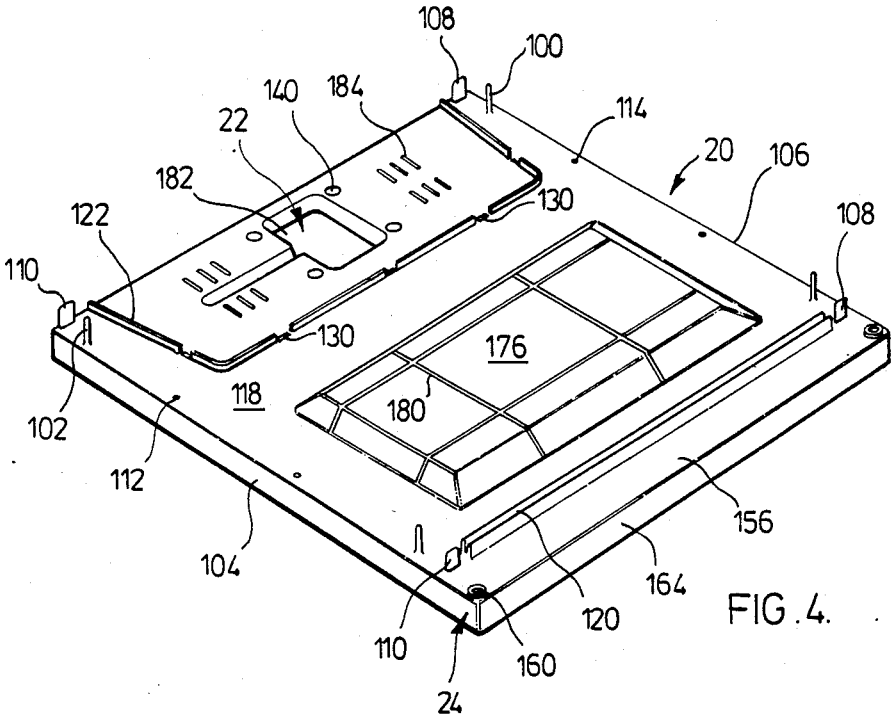
FIG. 4 is a perspective view of the upper surface of the base.

The base 20 for the cabinet construction is molded from a rigid plastic. This facilitates the incorporation in the base of the many structural features which interact with the cabinet wrapper, liner and rear panel and compressor compartment shell to form a complete assembly, while at the same time allowing mounting of the compressor directly onto the base. As shown in FIG. 4, the base 20 includes upstanding pins 100 and 102 which are in register with the corresponding apertures 70 and 72 in flanges 66 and 68 of the wrapper sides 56 and 58. As shown in FIG. 7, pin 102 is aligned with aperture 72 where their relationship is such that when the pin 102 is inserted in aperture 72, the cabinet flange is properly aligned with that side 104 of the cabinet base. The same relationship applies for pins 100 and apertures 70 in locating and mounting the wrapper flange 66 on the other side 106 of the cabinet base.

Upstanding tabs 108 and 110 are provided at the front and rear portions of the base of FIG. 4. The tabs 108 and 110 extend into the U-shaped channel 82 of the corresponding front and rear peripheral edge portions 62 and 64 of the wrapper. As shown in FIG. 7, upstanding tab 110 is inserted in the direction of arrow 112 into the U-shaped recess 82 to further enhance the alignment of the cabinet wrapper with the base 20. The flange 68 extends short of the U-shaped recess 82 to allow the upstanding tab 110 to pass beyond the flange 68 and into the U-shaped recess 82 of the respective edge 62 of the wrapper. Apertures 112 and 114 are provided on the sides 104 and 106 of the base of FIG. 4. These apertures are aligned with apertures 71 and 73 in the flanges 66 and 68 to permit insertion of screws from the underside of the base. The screws are self-tapping and engage the tap plates behind aligned aperture 73 as shown in FIG. 7. This secures the base to the wrapper sides to form a foam tight seal between the flanges 66 and 68 and the base upper surface 118. The base upper surface 118 also includes an integral raised U-shaped channel 120 into which the bottom of the liner periphery 98 is inserted. This relationship is shown more clearly in FIG. 1 where the liner periphery 98 is received by the raised U-shaped channel 120 to form a foam tight seal along the lower edge of the liner and base portion.

Figure 9:
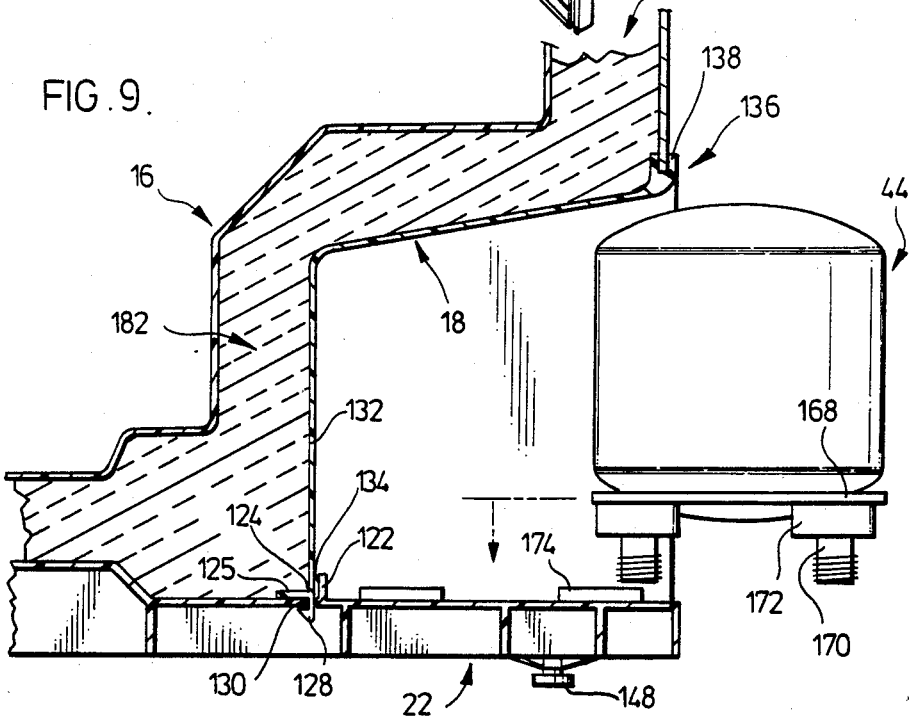
FIG. 9 is a section through the rear portion of the assembled refrigerator cabinet with compressor about to be mounted on the cabinet the base.

The upper surface 118 includes a ridge 122 which in combination with the bottom perimeter of the compressor compartment shell 18 forms a foam tight seal between the shell and the base upper surface 118. With reference to FIG. 9, the detail of the ridge 122 is shown in relation to the bottom perimeter 124 of the shell 18. The shell bottom has depending barbs 128 which are snap fitted in corresponding apertures 130 in the base. The shell vertical wall 132 abuts the inner surface 134 of the ridge 122. A flange extends about the shell bottom perimeter 124 and abuts base surface 118. The flange 125 acts as a foam seal for the cavity 42. The front U-shaped perimeter 136 of the compressor compartment shell includes a U-shaped recess 138 for receiving the edge of the U-shaped opening 74 of the rear panel 14. This U-shaped recess 138 is shown as extending around the entire front perimeter 136 of the compressor shell 18. This arrangement provides foam tight seals amongst the shell 18, the base 20 and the rear panel 14.

Figure 5:
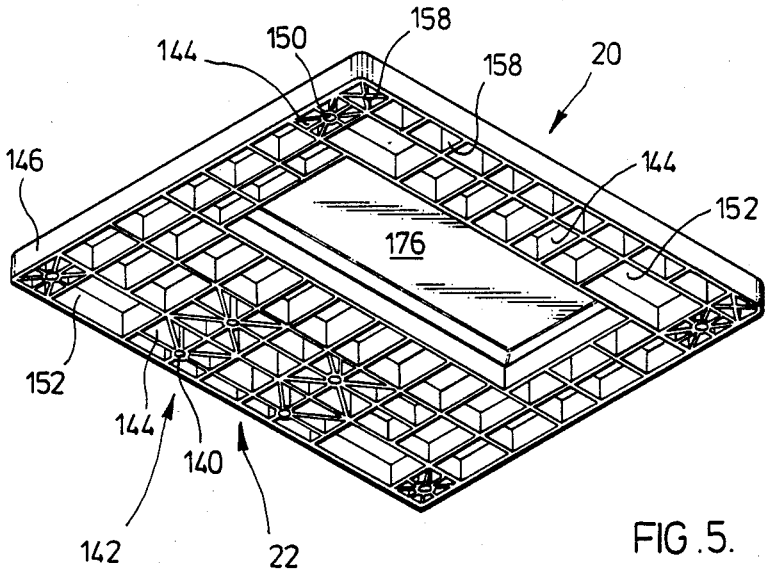
FIG. 5 is a perspective view of the underside of the base.

The compressor support portion 22 of the base has a planar upper surface with four spaced-apart bores 140. Referring to the underside 142 of the base 20, as shown in FIG. 5, the compressor support region 22 includes additional cross ribbing 144 in the area of each bore 140. This provides the additional support needed to carrying the weight of the compressor. The underside 142 of the base 20 includes an additional grid work of reinforcing ribs 144. At the corner areas 146, additional reinforcing ribs 144 are provided for the levelling legs 148 which are screwed into the apertures 150. The apertures 150 have formed integrally therein a threaded bore which receives the threaded levelling leg 148 as shown in FIG. 3. In addition, pockets 152 are provided on the underside to receive the roller devices 154 which include a wheel 156 and a mounting plate 158 which is friction fit within the opening 152.

In order to provide for the hinge supports 24, an extension 156 is provided on the base to extend beyond the front levelling legs and rollers of the base arrangement. This extension 156 also includes a plurality of reinforcing ribs 158 to support the cantilever mounting of the extension 156 in providing the smooth continuation of the upper surface 118. In each corner, additional reinforcing ribs 158 are provided in the extension to reinforce the component 24 for the hinge mounting of the cabinet door. As shown in FIG. 1, the hinge component is an aperture 160 which receives the depending pin 162 of the door hinge component, as shown in FIG. 1, so that the door may swing freely as supported by the extension 156 of the base assembly. The front wall 164 of this extension is approximately flush with the exterior surface 166 of the cabinet door 26 to provide a kick panel beneath the door and an attractive finished appearance across the base of the refrigerator front.

Returning to the compressor mounting of FIG. 9, the compressor 44 has a mounting plate 168 through which threaded bolts 170 extend. Mounting bushings 172 and 174 are provided on top of the support portion 22 of the base to dampen vibration generated by the compressor motor and reduce the transmission of sound through the plastic base to the refrigerator cabinet. By use of the plastic base, a quieter refrigerator operation is achieved because the plastic base in combination with the sound dampening bushings 172 and 174 deaden the sound. In addition, having the compressor compartment shell 132 formed of plastic, a further attenuation of the sound generated by the compressor motor is achieved. The bolts 170 may be formed of Nylon (trademark) or other plastic so as to engage the threaded apertures 140 of the compressor support 22 and provide a further dampening of the noise generated by the compressor motor. In addition, this mounting arrangement is all of plastic and rubber which reduces the likelihood of any moisture causing rusting and corrosion in the area of the compressor mount.

To reduce the volume between the base 20 and the bottom 54 of the liner, the base 20 includes in its upper surface a raised portion 176 which opposes the lower portion 54 in the liner to provide a narrowed portion 178 in the cavity 42. This reduces the amount of foam insulation required in this area and also improves on the flow characteristics of the unset foam to ensure that all portions of the cavity in this area are properly filled with foam insulation to the desired density. The raised portion 176 may include reinforcing ribs 180 to strengthen to a marginal extent the raised portion 176. As shown in FIG. 9, the cavity 42 defined between the liner and other cabinet components is filled with the foam insulation 182. As is appreciated, a release film may be applied to the inner surface of the liner 16 such that when the foam 182 sets, it does not adhere to the inner surface of the liner 16 so that the liner may expand and contract due to varying temperatures within the refrigerator without placing any undue strain on the liner and thereby avoid stress cracks in the liner.

It is appreciated that the compressor compartment shell 18, as shown in FIG. 8, may be used with refrigerator cabinets having other than plastic base portions 22.

The plastic compartment shell may be used with other styles of refrigerator cabinet designs, where it is desirable to include the advantages of the molded shell of plastic which has noise attenuation and electrical shock prevention characteristics. In addition, an electrical connection box 139 of FIG. 8 for the electrical wiring leading to the compressor motor may be integrally molded on the compartment shell to improve on an electrical shock proof system.

Further features of the plastic base, include forming about the compressor support portion 22 a recessed well 184 of FIG. 4 into which condensate from within the refrigerator may be transferred. The heat from the operating compressor can then be used to evaporate the condensate from the well defined about the compressor support 22. Ventilation slits 184 may be provided beneath the compressor to allow cooling air to pass upwardly over the compressor.

It is also appreciated that in the use of a plastic base and the avoidance of metal components used in mounting the compressor within the compressor compartment, corrosion problems are eliminated. This also alleviates previous problems with metal bases which had contact with the floor and would leave rust spots on the floor. In addition, the plastic acts as a heat insulator to reduce heat transfer to flooring beneath the refrigerator where, in the past, such heat can be sufficient to cause warpage and damage to the flooring.

The molding of the plastic base may be accomplished by injection molding techniques where a preferred form of plastic used is polyvinyl chloride. The plastics may be reinforced with glass fibres or sections of metal may be molded into the base in the injection molding process. For example, with the corner support hinge component 24 at each corner of the cantilevered extension 156 of the base, metal plates may be integrally molded within these portions to support the door hinges and prevent cold flow causing a warpage of the door support over time. In addition, a metal plate could also be integrally molded with the compressor support 22. These metal plate inserts are completely surrounded and encapsulated by molded plastic.

It is apparent from this discussion of the refrigerator cabinet design according to this invention, that there is a substantial reduction in the number of parts required to assemble the refrigerator cabinet. Compared to well known designs involving a false bottom, there is approximately a 50% reduction in parts required and thus a significant reduction in assembly and sub-assembly times and the elimination of several fabrication steps. This arrangement readily lends itself to assembly by robotics which can substantially increase the rate of production of the refrigerator. By the use of foam insulation which rigidifies when the cavity 42 is filled with foam, the entire structure takes on a rigid configuration. In the foaming technique, all of the interconnections of the rear panels and liners with the hU-shaped front and rear recessed edges form a foam tight seal such that when the foam is introduced into the cavity and rigidifies, the connections are permanently secured.

The molding of the refrigerator base also lends itself to the use of various colored plastics so as to color coordinate the base with the refrigerator cabinet color as may be required in the more expensive lines of refrigerators. It is appreciated that depending upon the size of the refrigerator, different size bases may be required. However, usually with a judicial selection of base sizes, a number of different volumes for the refrigerators may be provided with a minimum number of different base sizes required.

Although various preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A foam insulated refrigerator cabinet assembly comprising a metal outer wrapper which defines the cabinet sides and top, a molded plastic base on which said outer wrapper is mounted, a rear panel having a compressor compartment shell associated with its lower portion and a front cabinet liner, said compressor compartment shell having a bottom perimeter, each cabinet side having a lower marginal edge with means for connection to said base, the cabinet sides and top having front and rear peripheral edges with means for forming foam tight seals with the liner and rear panel peripheral edges, said compartment shell having its bottom perimeter connected to said base to form a foam tight seal and thereby define a compressor compartment directly above said base, said base having an integral support portion within said compartment for supporting a compressor, said base having means for forming a foam tight seal and connection with said front cabinet liner and having means for forming a foam tight seal and connection with said rear panel having said compressor compartment shell associated therewith, a cavity which is defined between assembled components of said wrapper base, rear panel, compartment shell, and liner being filled with an expanded rigid foam insulation to complete the assembly.

2. A refrigerator cabinet of claim 1, wherein said support portion has a plurality of spaced-apart threaded apertures for receiving bolts which secure a compressor to said base support.

3. A refrigerator cabinet of claims 1 or 3, wherein said support portion includes a plurality of integral reinforcing ribs beneath the base support surface.

4. A refrigerator cabinet of claim 1, wherein said base has an upwardly projecting ridge against which said shell bottom perimeter abuts in forming said foam tight seal.

5. A refrigerator cabinet of claim 4, wherein said base and said shell bottom perimeter have co-operating means for interconnecting the shell to the base, said shell being molded from plastic.

6. A refrigerator cabinet of claim 1, wherein said base has opposing planar side portions which are in register with the side lower marginal edges of the wrapper, each base side portion having spaced-apart, upwardly projecting pins and each wrapper side lower marginal edge having a transverse flange with apertures therein which are in register with the corresponding pins of the base side whereby said apertures and pins guide the placement of said base onto said wrapper.

7. A refrigerator cabinet of claim 6, wherein means secures said flange portions to said base along its sides.

8. A refrigerator cabinet of claim 1, wherein said base has a recessed channel portion extending across the front portion of said base to receive a bottom portion of the periphery of said liner and form a foam tight seal therewith.

9. A refrigerator cabinet of claim 1 or 4, wherein said means on the front and rear edges of said wrapper comprise a reverse bend to define a channel to receive the corresponding rear panel edge and liner edge, said base having upstanding tabs which extend into the lower portions of the channels of the front and rear wrapper edges to locate said wrapper on said base.

10. A refrigerator cabinet of claim 1, wherein a depression is provided around said support for a compressor, said depression accommodating any condensate run off from an operating refrigerator to evaporate such water by the heat generated by an operating compressor.

11. A refrigerator cabinet of claim 1, wherein said base has in its central area a raised planar portion opposite a corresponding depressed lower portion of said liner to control thereby the flow of foaming insulation between said base and liner prior to said insulation rigidifying.

12. A refrigerator cabinet of claim 1, wherein said molded plastic base has a levelling leg support proximate each corner of the base, said leg support including a threaded bore into which a corresponding levelling leg is threaded.

13. A refrigerator cabinet of claim 12, wherein said molded base extends forwardly of the leg supports at the base front to provide a base plate extending outwardly of the liner and along the refrigerator front, said base plate having at an end portion thereof means for mounting a cabinet door on said cabinet.

14. A refrigerator cabinet of claim 13, wherein said door mounting means comprises a vertically-oriented aperture into which a downwardly depending pin on a cabinet door is inserted to provide for pivotal mounting of a cabinet door at its lower end.

15. A refrigerator cabinet of claim 1, wherein said base is injection molded from polyvinyl chloride and comprises a rectangular upper surface with depending front and rear walls and opposing side walls, a structural reinforcing gridwork of ribs depending from the underside of the base upper surface, said gridwork providing reinforcing for a compressor support, levelling supports at the base corners and a cabinet door hinge mounting at a base front corner.

16. A refrigerator cabinet of claim 15, wherein the central area of said upper surface is raised, the underside of said central area being devoid of said reinforcing gridwork.

17. A refrigerator cabinet of claim 1, wherein said compartment shell is detachable from said rear panel, said compartment shell having an open U-shaped front with side and rear walls which define said bottom perimeter, said rear panel having a U-shaped opening for receiving the perimeter of the front of said shell, said front perimeter having means for forming a foam tight seal with said rear panel said rear panel having lower portions which extend downwardly of each side of said compartment shell where said seal means on said base forms a foam tight seal with said rear panel lower portion.

18. In a refrigerator cabinet construction having a rolled-formed, three-sided metal wrapper to form the sides and top of said cabinet, a front liner, a rear panel having a compressor compartment shell assembled therewith, an injection molded plastic base for interconnecting said wrapper sides, front liner and rear panel compressor compartment shell, the improvement comprising said base having a support portion molded therein below said compartment shell to support a compressor within said compressor compartment, said base having means for locating said wrapper thereon in preparation for permanent securement of said base to said wrapper, said wrapper sides each having a lower edge with means co-operating with said locator means on said base, said co-operating means comprising at least two spaced-apart apertures in a planar flange integral with said lower edge, said locator means on said base comprising at least two spaced-apart upstanding pins which correspond in spacing with the apertures in each said flange, said pins when inserted through corresponding flange apertures aligning said wrapper sides with said base, said wrapper sides and top having front and rear edges which are provided with means for receiving corresponding edges of said front liner and corresponding edges of said rear panel, said base locator means co-operating with said receiving means of the front and rear edges of the wrapper for locating said wrapper on said base.

19. In a refrigerator cabinet construction having a rolled-formed, three-sided metal wrapper to form the sides and top of said cabinet, a front liner, a rear panel having a compressor compartment shell assembled therewith, an injection molded plastic base for interconnecting said wrapper sides, front liner and rear panel compressor compartment shell, the improvement comprising said base having a support portion molded therein below said compartment shell to support a compressor within said compressor compartment, said base having a component of a hinge for mounting a door on said cabinet, said base extending outwardly of said wrapper front edge, said hinge component of said base comprising a vertically extending aperture for receiving a downwardly depending pin on a cabinet door, said base extension being substantially co-extensive with the exterior of said door when mounted on said cabinet.

* * * * *

UNITED STATES PATENT AND TRADEMARK OFFICE

CERTIFICATE OF CORRECTION

PATENT NO. : 4,580,852

DATED : April 8, 1986

INVENTOR(S) : Ter Smitte, et al

It is certified that error appears in the above-identified patent and that said Letters Patent is hereby corrected as shown below:

On the title page:

Item [19] should read --Ter Smitte et al

Item [75] should read -- Cory Ter Smitte--.

Signed and Sealed this

First Day of July 1986

[SEAL]

Attest:

DONALD J. QUIGG

Attesting Officer

Commissioner of Patents and Trademarks